US010250995B2

(12) United States Patent
Doshida

(10) Patent No.: US 10,250,995 B2
(45) Date of Patent: Apr. 2, 2019

(54) PIEZOELECTRIC SPEAKER AND ELECTROACOUSTIC TRANSDUCER

(71) Applicant: TAIYO YUDEN CO., LTD., Chuo-ku, Tokyo (JP)

(72) Inventor: Yutaka Doshida, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 15/578,630

(22) PCT Filed: Mar. 4, 2016

(86) PCT No.: PCT/JP2016/056709
§ 371 (c)(1),
(2) Date: Nov. 30, 2017

(87) PCT Pub. No.: WO2016/194425
PCT Pub. Date: Dec. 8, 2016

(65) Prior Publication Data

US 2018/0176692 A1 Jun. 21, 2018

(30) Foreign Application Priority Data

Jun. 5, 2015 (JP) ..... 2015-114482
Jun. 22, 2015 (JP) ..... 2015-124514

(51) Int. Cl.
*H04R 17/10* (2006.01)
*H04R 1/10* (2006.01)
(Continued)

(52) U.S. Cl.
CPC ..... *H04R 17/10* (2013.01); *H04R 1/1008* (2013.01); *H04R 9/02* (2013.01); *H04R 9/06* (2013.01); *H04R 5/033* (2013.01)

(58) Field of Classification Search
CPC ..... H04R 17/10; H04R 1/1008; H04R 9/02; H04R 9/06
See application file for complete search history.

(56) References Cited

U.S. PATENT DOCUMENTS

2004/0124748 A1* 7/2004 Takeshima ..... H04R 17/00 310/331
2012/0148073 A1* 6/2012 Kim ..... H04R 17/005 381/190
(Continued)

FOREIGN PATENT DOCUMENTS

JP S58109797 U 7/1983
JP 2004147077 A 5/2004
(Continued)

OTHER PUBLICATIONS

International Search Report (ISR) dated Apr. 12, 2016, issued for International application No. PCT/JP2016/056709.

*Primary Examiner* — Sonia L Gay
(74) *Attorney, Agent, or Firm* — Law Office of Katsuhiro Arai

(57) ABSTRACT

In an embodiment, a piezoelectric speaker 30 includes a sheet member 32 and multiple piezoelectric vibration parts 31. The multiple piezoelectric vibration parts 31 each have a vibration plate 311 supported on the sheet member 32 in a vibratable manner, as well as a piezoelectric element 312 joined to the vibration plate 311. In an embodiment, the piezoelectric speaker 30 in combination with a dynamic speaker 20 constitutes an electroacoustic transducer 104L/104R, and a pair of the electroacoustic transducers 104L, 104R constitute headphones 100. The piezoelectric speaker can improve sound pressures without lowering the resonance frequency.

14 Claims, 7 Drawing Sheets

(51) Int. Cl.

| | |
|---|---|
| ***H04R 9/02*** | (2006.01) |
| ***H04R 9/06*** | (2006.01) |
| ***H04R 5/033*** | (2006.01) |

(56) References Cited

U.S. PATENT DOCUMENTS

| | | | | |
|---|---|---|---|---|
| 2013/0094678 | A1* | 4/2013 | Scholte | G01H 3/125<br>381/182 |
| 2013/0267275 | A1* | 10/2013 | Onishi | H04M 1/0254<br>455/556.1 |
| 2013/0294636 | A1* | 11/2013 | Cassett | H04R 1/02<br>381/386 |
| 2016/0044405 | A1 | 2/2016 | Huang et al. | |

FOREIGN PATENT DOCUMENTS

| | | | |
|---|---|---|---|
| JP | 2012134956 | A | 7/2012 |
| JP | 2013150305 | A | 8/2013 |
| JP | 3196707 | U | 3/2015 |

* cited by examiner

[FIG. 1]
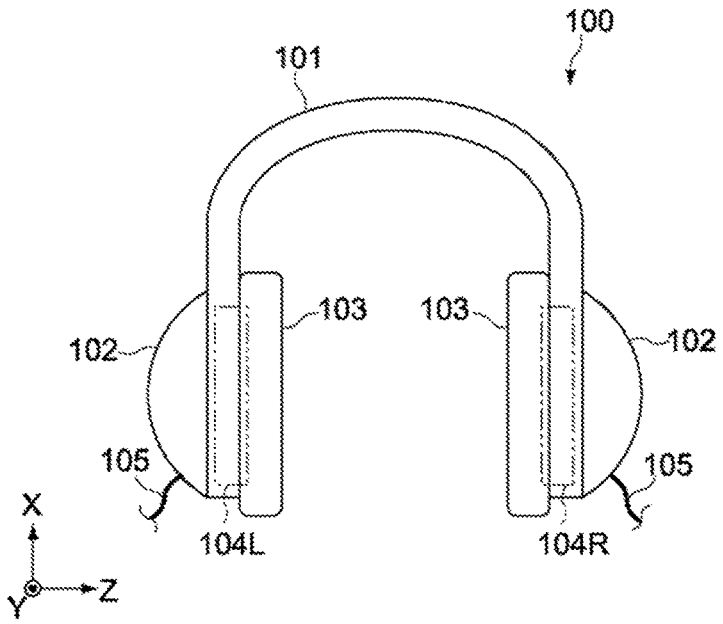
[FIG. 2]
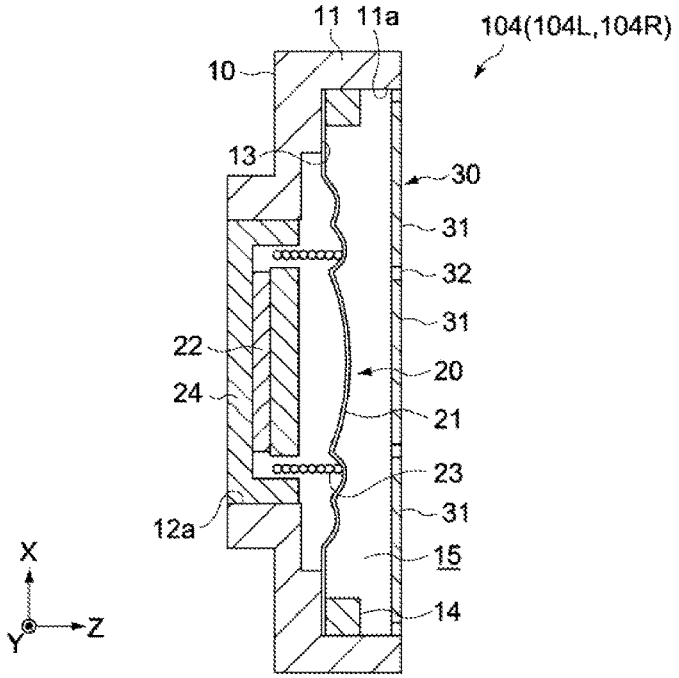

[FIG. 3]
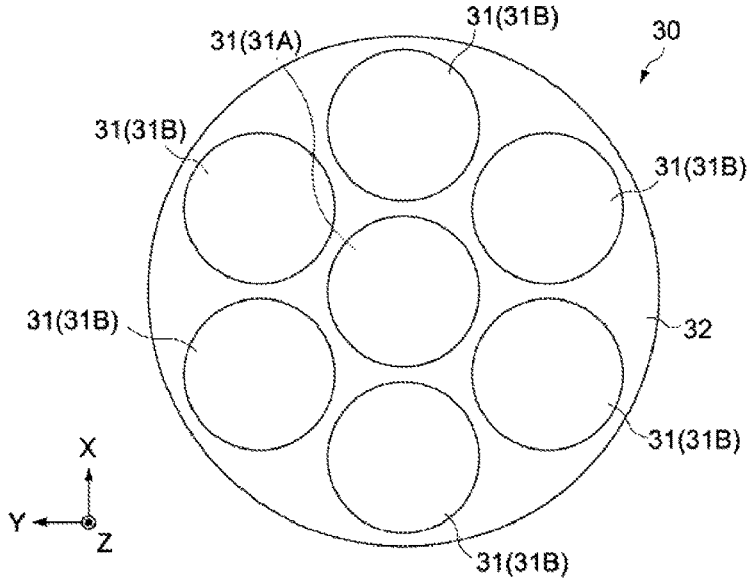
[FIG. 4]
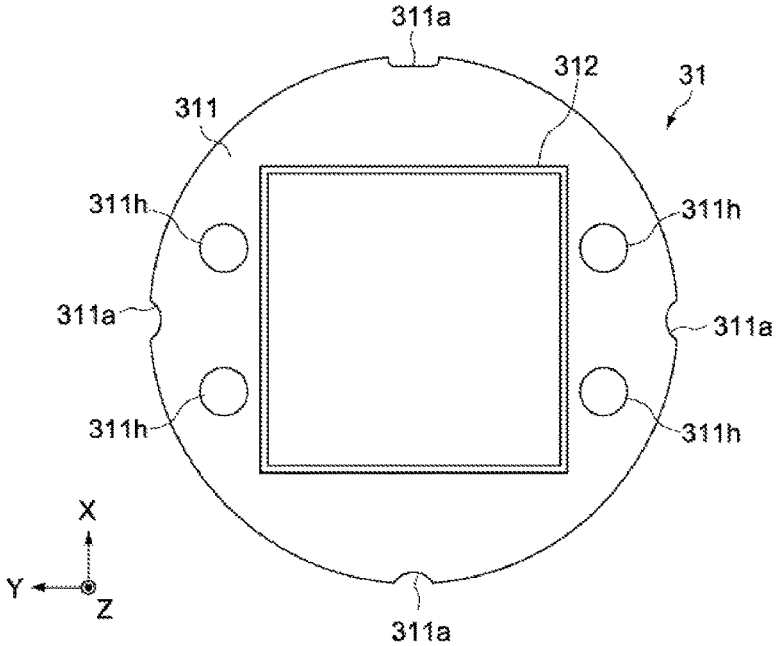

[FIG. 5]
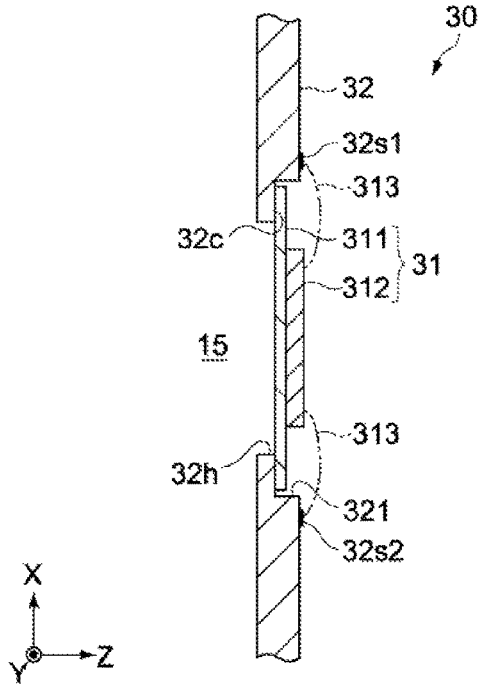
[FIG. 6]
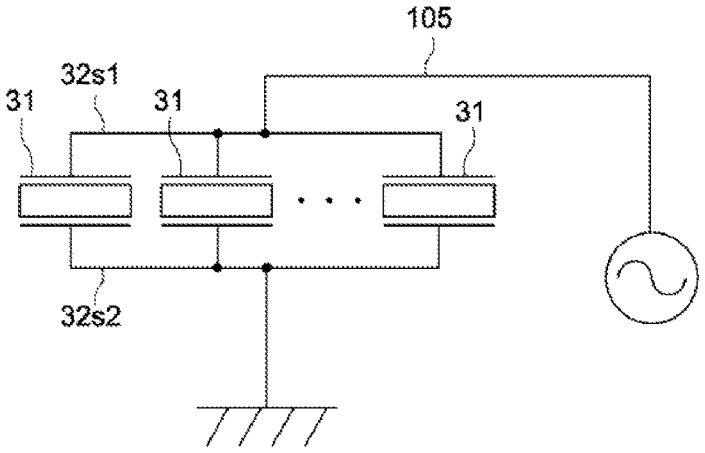

[FIG. 7]
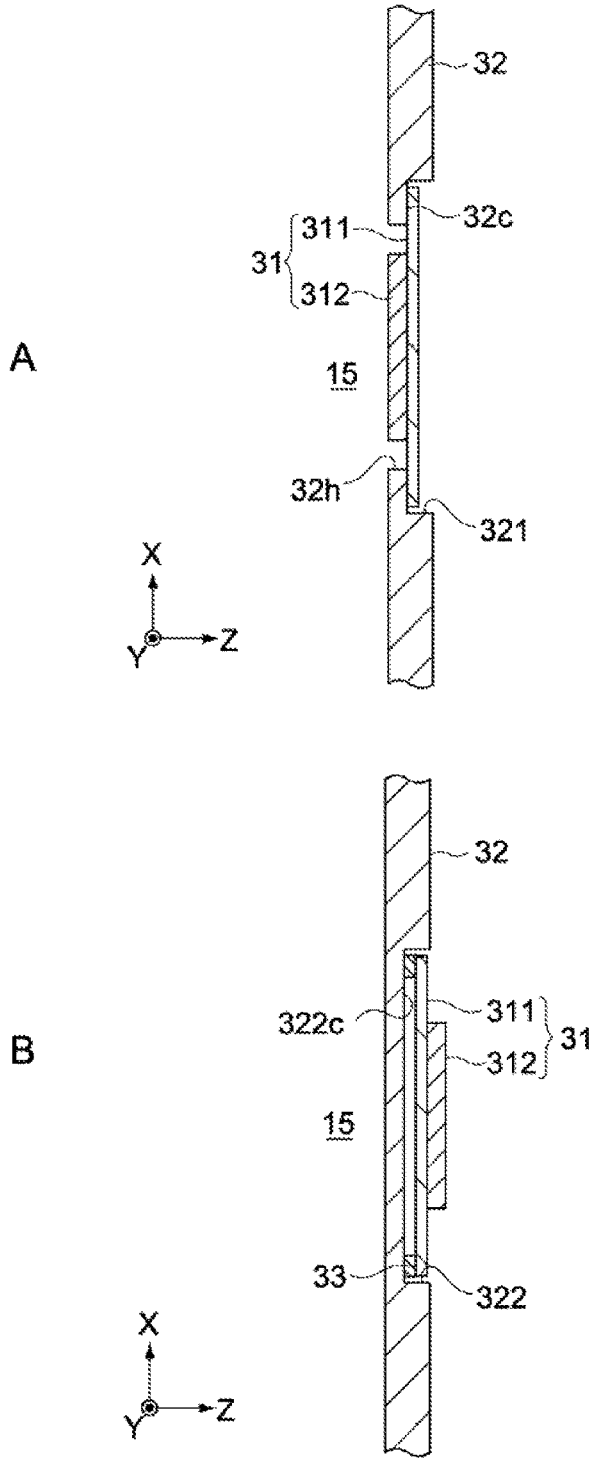

[FIG. 8]
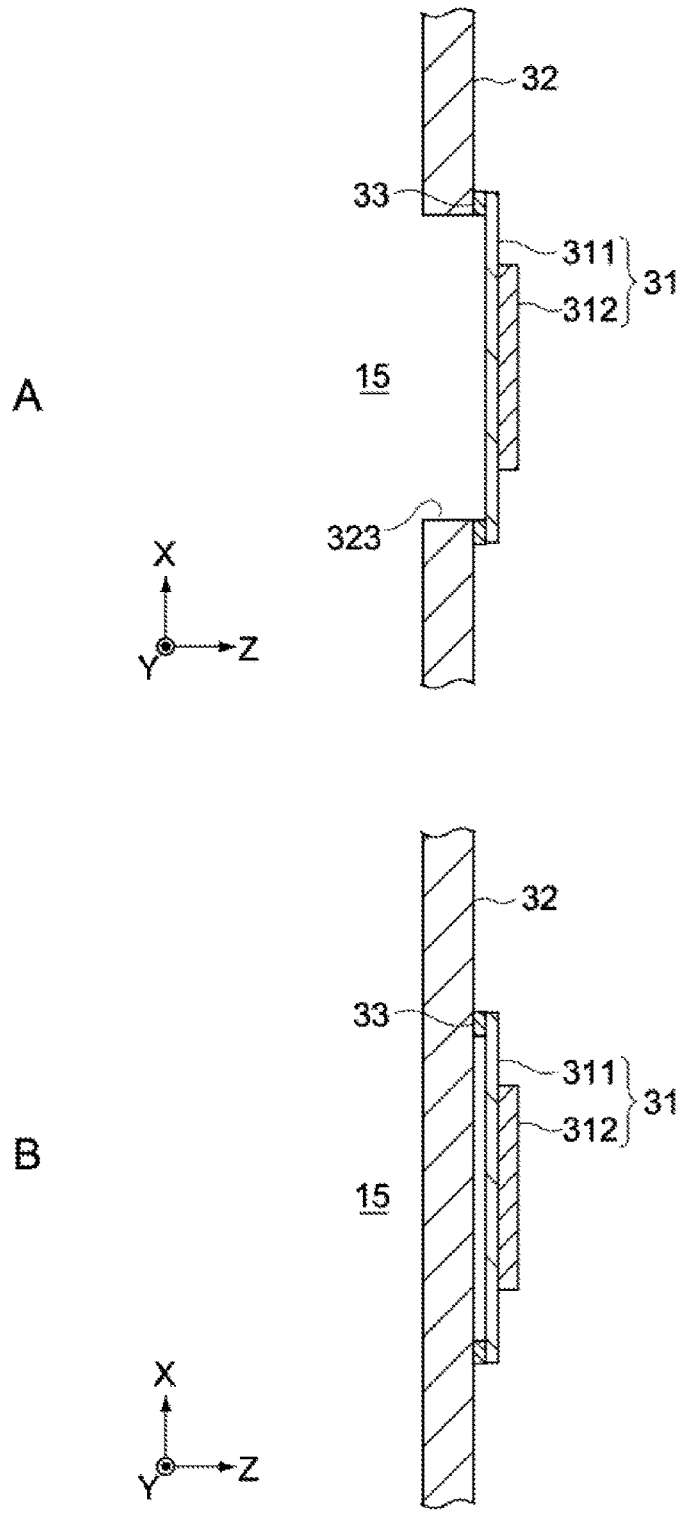

[FIG. 9]
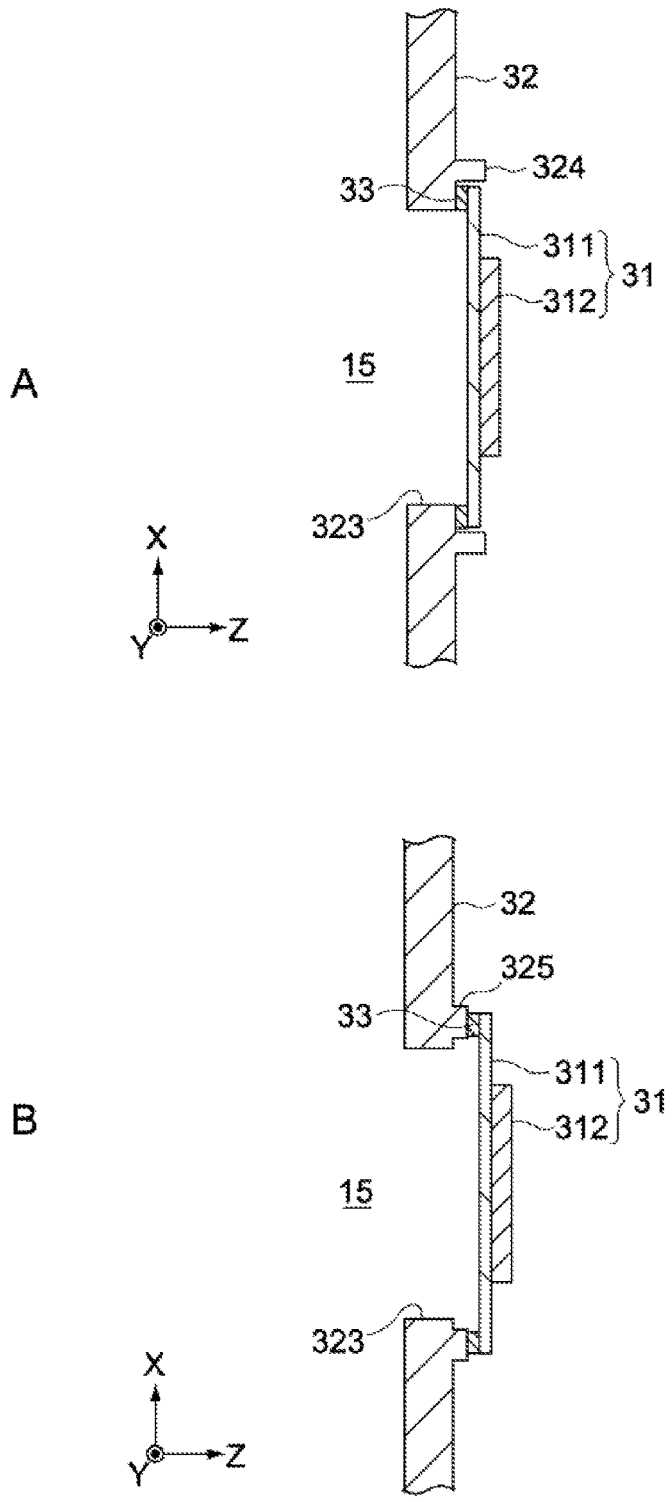

[FIG. 10]
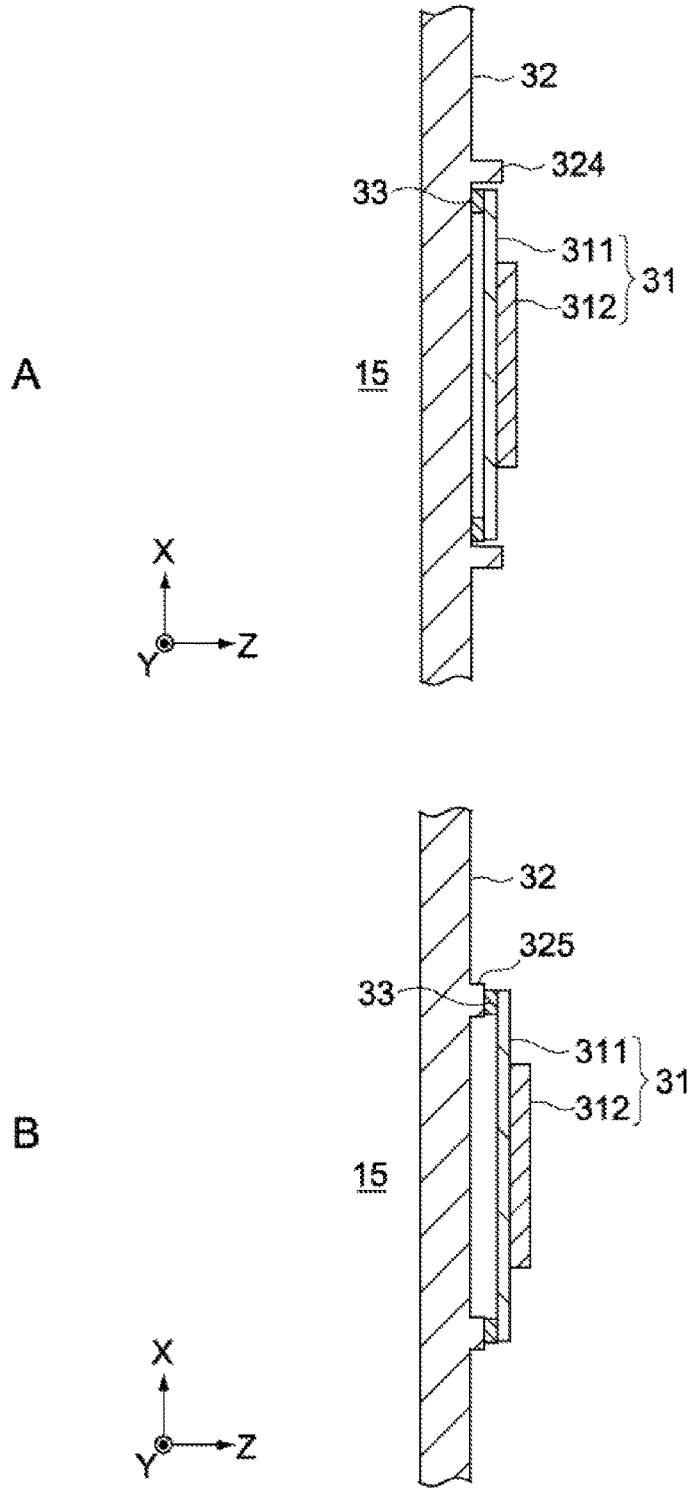

PIEZOELECTRIC SPEAKER AND ELECTROACOUSTIC TRANSDUCER

This application is the U.S. National Phase under 35 U.S.C. § 371 of International Application PCT/JP2016/056709, filed Mar. 4, 2016, which claims priority to Japanese Patent Application No. 2015-114482, filed Jun. 5, 2015. The International Application was published under PCT Article 21(2) in a language other than English.

TECHNICAL FIELD

The present invention relates to a piezoelectric speaker and electroacoustic transducer that can be applied to electronic components such as earphones, headphones, mobile information terminals, for example.

BACKGROUND ART

Piezoelectric speakers are widely used as simple electroacoustic conversion means in earphones, headphones, and other acoustic devices, and speakers for mobile information terminals, for example. For instance, Patent Literature 1 discloses a piezoelectric speaker constituted by a piezoelectric element joined to a vibration plate made of metal material.

Also, recent acoustic devices include hybrid electroacoustic transducers. For instance, Patent Literature 2 discloses a complex speaker combining a dynamic speaker (electromagnetic sounding body) and a piezoelectric speaker (piezoelectric sounding body).

BACKGROUND ART LITERATURE

Patent Literature

Patent Literature 1: Japanese Patent Laid-open No. 2013-150305

Patent Literature 2: Japanese Patent Laid-open No. 2004-147077

SUMMARY OF THE INVENTION

Problems to be Solved by the Invention

In recent years, there is a need for piezoelectric speakers offering improved sound pressures. In general, increasing the diameter of the vibration plate is advantageous in improving the sound pressure. However, increasing the diameter of the vibration plate inevitably lowers the resonance frequency, which makes it difficult to reliably achieve desired high note characteristics. This means that the piezoelectric speaker (tweeter) cannot support an increase in the diameter of the dynamic speaker (woofer), making it difficult to achieve a hybrid electroacoustic transducer offering high sound pressures.

In light of the aforementioned situation, an object of the present invention is to provide a piezoelectric speaker that can improve sound pressures without lowering the resonance frequency, as well as an electroacoustic transducer equipped with such piezoelectric speaker.

Means for Solving the Problems

To achieve the aforementioned object, the piezoelectric speaker pertaining to an embodiment of the present invention comprises a sheet member and multiple piezoelectric vibration parts. The multiple piezoelectric vibration parts each have a vibration plate supported on the sheet member in a vibratable manner, as well as a piezoelectric element joined to the vibration plate.

The piezoelectric speaker has a structure where the multiple piezoelectric vibration parts are supported on the sheet member. This way, sound pressures can be improved without lowering the resonance frequency of the individual piezoelectric vibration parts. Also, the constitution of each piezoelectric vibration part can be optimized independently, which makes it easy to adjust the resonance frequency and other acoustic characteristics.

The multiple piezoelectric vibration parts are arranged in-plane on the sheet member with a spacing provided in between. This way, the multiple piezoelectric vibration parts can be distributed over a wide area on the sheet member.

The multiple piezoelectric vibration plates can be arranged at symmetrical positions with respect to the center of the sheet member. This way, acoustics having sound pressure characteristics that are symmetrical with respect to the center of the sheet member can be generated.

For example, the multiple piezoelectric vibration parts may include a first piezoelectric vibration part arranged at the center of the sheet member, and multiple second piezoelectric vibration parts arranged around the first piezoelectric vibration part with an equal angle spacing provided in between.

The sheet member may further have signal wiring parts that are electrically connected to the multiple piezoelectric vibration parts, respectively. This makes wiring each piezoelectric vibration part easy.

The electroacoustic transducer pertaining to an embodiment of the present invention comprises a sheet member, multiple piezoelectric vibration parts, a dynamic speaker, and a support.

The multiple piezoelectric vibration parts each have a first vibration plate supported on the sheet member in a vibratable manner, as well as a piezoelectric element joined to the first vibration plate.

The dynamic speaker faces the sheet member and has a second vibration plate.

The support supports the sheet member and the dynamic speaker.

The electroacoustic transducer has a structure where the multiple piezoelectric vibration parts are supported on the sheet member. This way, sound pressures can be improved without lowering the resonance frequency of the piezoelectric speaker. Also, a hybrid electroacoustic transducer capable of supporting improved sound pressures can be achieved.

The first vibration plate may have a disk shape whose diameter is smaller than that of the second vibration plate, and the sheet member may have a disk shape whose diameter is the same as or greater than that of the second vibration plate. Even in this case, where the second vibration plate is larger than the first vibration plate, desired sound pressures can be achieved without reducing the frequency characteristics in the high range.

The first vibration plate may have one or more through holes provided between the periphery part of the first vibration plate and the piezoelectric element. Each such through hole functions as a passage part that passes the acoustics generated by the dynamic speaker. This allows the frequency characteristics of the sound waves reproduced by the dynamic speaker to be adjusted.

Effects of the Invention

As described above, it is possible, according to the present invention, to improve sound pressures without lowering the resonance frequency.

BRIEF DESCRIPTION OF THE DRAWINGS

FIG. 1 Schematic side view showing the constitution of an acoustic device equipped with the electroacoustic transducer pertaining to an embodiment of the present invention.

FIG. 2 Schematic cross-sectional side view showing the constitution of the electroacoustic transducer.

FIG. 3 Schematic front view of the piezoelectric speaker in the electroacoustic transducer.

FIG. 4 Schematic front view of the piezoelectric vibration part in the piezoelectric speaker.

FIG. 5 Schematic cross-sectional side view of key parts of the piezoelectric speaker.

FIG. 6 Equivalent circuit diagram explaining the mode of electrical connection of the piezoelectric speaker.

FIGS. 7 A and B are each a schematic cross-sectional side view of key parts, showing a variation example of the constitution shown in FIG. 5.

FIGS. 8 A and B are each a cross-schematic sectional side view of key parts, showing a variation example of the constitution shown in FIG. 5.

FIGS. 9 A and B are each a schematic cross-sectional side view of key parts, showing a variation example of the constitution shown in FIG. 8A.

FIGS. 10 A and B are each a schematic cross-sectional side view of key parts, showing a variation example of the constitution shown in FIG. 8B.

MODE FOR CARRYING OUT THE INVENTION

An embodiment of the present invention is explained below by referring to the drawings.

FIG. 1 is a schematic side view showing the constitution of headphones 100 being the acoustic device pertaining to an embodiment of the present invention.

In the figure, the X-axis, Y-axis and Z-axis indicate three axis directions intersecting at right angles.

[Overall Constitution of Headphones]

The headphones 100 comprise a headband 101, a pair of housings 102 attached at both ends of the headband 101, a pair of earpads 103 respectively attached on the inner side of the housings 102, etc.

The pair of earpads 103 are arranged in such a way that, when a user wears the headphones 100 over his/her head, they will cover both ears of the user. The pair of housings 102 have built-in speaker units 104L, 104R, respectively, as electroacoustic transducers.

The speaker unit 104L reproduces acoustic signals for the left ear, while the speaker unit 104R reproduces acoustic signals for the right ear. The housings 102 have a wiring cable 105 connected to them in order to input drive signals (acoustic signals) to the speaker units 104L, 104R. The speaker units 104L, 104R both have the same constitution. The speaker units 104L, 104R are collectively referred to the "speaker unit 104" below, except when they are explained individually.

[Speaker Unit]

Next, the details of the speaker unit 104 are explained. FIG. 2 is a schematic cross-sectional side view showing the constitution of the speaker unit 104.

The speaker unit 104 has a support 10, a dynamic speaker 20, and a piezoelectric speaker 30.

(Support)

The support 10 has a shallow circular dish shape formed by synthetic resin material or other insulating material, for example. The support 10 is constituted by a single member that commonly supports the dynamic speaker 20 and the piezoelectric speaker 30; however, it is not limited to this constitution and may be constituted by multiple members.

The support 10 has a side wall part 11 that forms a space part 15 between the dynamic speaker 20 and the piezoelectric speaker 30. The side wall part 11 is formed as a cylinder shape whose shaft center runs in parallel with the Z-axis direction. The space part 15 accommodates the dynamic speaker 20 and the piezoelectric speaker 30.

(Dynamic Speaker)

The dynamic speaker 20 functions as a woofer that reproduces the low range, and is constituted, in this embodiment, by a dynamic speaker that primarily generates sound waves of 7 kHz or less, for example. The constitution of the dynamic speaker 20 is not limited in any way, and it has, in this embodiment, a vibration plate 21 (second vibration plate), a permanent magnet 22, a voice coil 23, and a yoke 24 that supports the permanent magnet 22.

The vibration plate 21 has a circular outer shape, as well as multiple ring-shaped concave/convex in-plane shapes defining bulges in the thickness direction (Z-axis direction). The vibration plate 21 is supported on the support 10, with its periphery part sandwiched between a bottom part 13 of the support 10 and a ring-shaped bracket 14 assembled integrally thereto. The vibration plate 21 is constituted by metal material, synthetic resin material, fiber material, paper or other material as deemed appropriate. The shape of the vibration plate 21 is not limited in any way, either, and can be set as deemed appropriate according to the specification, etc.

The yoke 24 is arranged inside a through hole 12*a* formed at the center part of the support 10, and its peripheral face is fixed to the inner peripheral face of the through hole 12*a*. The yoke 24 is constituted by material of high magnetic permeability, and has a magnetic gap part that can accommodate the voice coil 23 at least partially.

The voice coil 23 is formed by winding a conductive wire around a bobbin as a center of winding, and joined to the center part of the vibration plate 21. Also, the voice coil 23 is arranged orthogonal to the direction of the magnetic flux of the permanent magnet 22 (i.e., around the axis running in parallel with the Z-axis in FIG. 2). As an alternating current (voice signal) is input to the voice coil 23 via the wiring cable 105, an electromagnetic force is applied to the voice coil 23 and the voice coil 23 vibrates in the Z-axis direction in the figure according to the signal waveform. This vibration transmits to the vibration plate 21 connected to the voice coil 23 and vibrates the air inside the space part 15, and the aforementioned sound waves in the low range generate as a result.

(Piezoelectric Speaker)

The piezoelectric speaker 30 functions as a tweeter that reproduces the high range, and in this embodiment, its oscillation frequency is set in such a way as to primarily generate sound waves of 7 kHz or higher, for example.

FIG. 3 is a schematic front view of the piezoelectric speaker 30.

As shown in FIG. 3, the piezoelectric speaker 30 has multiple piezoelectric vibration parts 31 and a sheet member 32 that supports these multiple piezoelectric vibration parts 31. In this embodiment, the respective piezoelectric vibration parts 31 have the same constitution, and are also constituted in such a way that they can vibrate independently from each other.

FIG. 4 is a schematic front view of the piezoelectric vibration part 31.

The piezoelectric vibration part 31 has a vibration plate 311 (first vibration plate) and a piezoelectric element 312.

The vibration plate 311 is constituted by metal (such as 42 alloy) or other conductive material, or resin (such as liquid crystal polymer) or other insulating material, and formed in such a way that its planar shape becomes an approximate circle. "Approximate circle" means not only a circle, but also virtual circles as described later.

The outer diameter and thickness of the vibration plate 311 are not limited in any way, and set as deemed appropriate according to the size of the sheet member 32, how many vibration parts 31 are arranged, frequency band of reproduced sound waves, and so on. Typically, the smaller the outer diameter of the vibration plate 311 or greater the thickness of the vibration plate 311, the higher the frequency band of reproduced sound waves becomes. The vibration plate 311 has a disk shape whose diameter is smaller than that of the vibration plate 21 of the dynamic speaker 20, and in this embodiment, a vibration plate of approx. 12 mm in diameter and approx. 0.2 mm in thickness is used.

It should be noted that the vibration plate 311 is not limited to one of planar shape, and may be a three-dimensional structure having a dome shape, etc. Also, each vibration plate 311 need not have the same diameter and thickness, and some vibration plates 311 may be constituted with diameters and thicknesses different from those of other vibration plates 311.

The vibration plate 311 may have cutout parts that are formed by convex shapes, slit shapes, etc., recessed inward from its outer periphery part. The planar shape of the vibration plate 311, although not strictly a circle due to formation of the cutout parts, etc., is considered a virtual circle so long as the outer shape is a circle. In this embodiment, arc-shaped or rectangular cutout parts 311*a* are provided at 90-degree spacings along the periphery part of the vibration plate 311, as shown in FIG. 4. These cutout parts 311*a* may be used as reference points that are referenced when the vibration plate 311 is joined to the sheet member 32, or they may be used as reference points that are referenced when the piezoelectric element 312 is positioned on the vibration plate 311.

A piezoelectric element 312 is joined to the surface of the vibration plate 311 at least on one side. In this embodiment, the piezoelectric vibration part 31 is constituted as a unimorph structure where a piezoelectric element 312 is joined to the surface of the vibration plate 311 on one side; however, it may be constituted as a bimorph structure where piezoelectric elements 312 are joined to the surfaces on both sides of the vibration plate 311.

As shown in FIG. 4, the planar shape (shape as viewed from the Z-axis direction) of the piezoelectric element 312 is formed as a polygon, or specifically a rhomboid (rectangle) in this embodiment. It should be noted that the planar shape of the piezoelectric element 312 is not limited to the foregoing, and may be a square, parallelogram, trapezoid or other quadrangle, or other polygon besides quadrangle, or even circle, ellipse, oval, etc. The thickness of the piezoelectric element 312 is not limited in any way, either, and may be approx. 50 μm, for example.

The piezoelectric element 312 has a structure where multiple piezoelectric layers and multiple electrode layers are alternately stacked together. Typically, the piezoelectric element 312 is produced by stacking multiple ceramic sheets made of lead zirconate titanate (PZT), alkali metal-containing niobium oxide or other material exhibiting piezoelectric characteristics (piezoelectric layers), with electrode layers in between, and then sintering the entire stack at a prescribed temperature. One ends of the respective electrode layers are alternately led out to both end faces of the piezoelectric layers. The electrode layer exposed to one end face is connected to a first lead electrode layer, while the electrode layer exposed to the other end face is connected to a second lead electrode layer. The piezoelectric element 312 extends and contracts at a prescribed frequency as a prescribed alternating-current voltage is applied between the first and second lead electrode layers, and the vibration plate 311 also vibrates at a prescribed frequency. The numbers of piezoelectric layers and electrode layers to be stacked are not limited in any way, and each set to any number of layers as deemed appropriate to achieve the necessary sound pressures.

Furthermore, as shown in FIG. 4, the vibration plate 311 has multiple passage parts 311*h*, each constituted by a through hole, provided between the periphery part of the vibration plate 311 and the piezoelectric element 312. The passage parts 311*h* are provided in the region between the side parts of the piezoelectric element 312 and the periphery part of the vibration plate 311. As they are provided in a manner facing the space part 15, the passage parts 311*h* function as passages that pass the acoustics generated by the dynamic speaker 20. This allows the frequency characteristics of the sound waves reproduced by the dynamic speaker 20 to be adjusted.

The shape of the passage part 311*h* is not limited in any way, and may be a circle, as shown in the figure, or an ellipse, oval or other approximate circle, or rectangle or other polygon. The size of the passage part 311*h* is not limited in any way, either, and can be set as deemed appropriate according to the size of the vibration plate 311 and the shape, size, etc., of the piezoelectric element 312. In addition, the passage part 311*h* constitution is not limited to one comprising multiple through holes; instead, there may be one passage part 311*h* constituted by a single through hole according to the size and shape.

On the other hand, the sheet member 32 has a disk shape, as shown in FIG. 3, and is installed on the inner peripheral face 11*a* of the side wall part 11 of the support 10, as shown in FIG. 2. The sheet member 32 has a disk shape whose diameter is the same as or greater than that of the vibration plate 21 of the dynamic speaker 20. This way, the dynamic speaker 20 is overlaid by the sheet member 32 via the space part 15 sandwiched in between. Although the thickness of the sheet member 32 is not limited in any way, typically this member is formed with a thickness that achieves appropriate rigidity to prevent it from vibrating even when the reactive force from the piezoelectric vibration part 31 as it vibrates, sound waves generated by the dynamic speaker 20, etc., are received. This way, stable frequency characteristics can be ensured for both the dynamic speaker 20 and piezoelectric speaker 30. It should be noted that the sheet member 32 is not limited to the forgoing and, depending on the specification, it may be constituted in a vibratable manner within a prescribed frequency range.

It should be noted that the sheet member 32 is not limited to this example where it is installed on the inner peripheral face 11*a* of the side wall part of the support 10; instead, it may be installed in a manner covering an open end of the side wall part 11. In this case, a ring-shaped step part (cutout) that engages with the periphery part of the sheet member 32 may be provided at the open end of the side wall part 11, or the sheet member 32 may be installed on the support 10 in a manner covering the open end.

In this embodiment, the vibration plate 21 of the dynamic speaker 20 and the sheet member 32 have an outer diameter roughly identical to the inner diameter of the side wall part 11 of the support 10. On the other hand, the vibration plate 21 of the dynamic speaker 20 has its periphery part fixed by the ring-shaped bracket 14, and therefore the effective diameter over which it functions as a vibration plate is roughly identical to the inner diameter of the ring-shaped bracket 14. This means that the sheet member 32 has an outer diameter greater than the effective diameter of this vibration plate 21.

It should be noted that the sheet member 32 is not limited to the foregoing and may be constituted with the same diameter as the effective diameter of the vibration plate 21. Also, when the inner peripheral face 11*a* of the side wall part 11 supporting the periphery part of the sheet member 32 is projecting inward in the diameter direction, then the sheet member 32 may be constituted with a diameter smaller than that of the vibration plate 21.

FIG. 5 is a cross-sectional view of key parts, showing the structure of how the piezoelectric vibration part 31 is fixed to the sheet member 32.

The sheet member 32 has multiple concave parts 321, each supporting one of the multiple piezoelectric vibration parts 31. In this embodiment, each concave part 321 is constituted by a bottomless through hole that penetrates through the sheet member 32 in its thickness direction; however, it may be constituted by a bottomed non-through hole formed on the surface of the sheet member 32 on one side, as described later. Each concave part 321 is formed to a size that can accommodate each piezoelectric vibration part 31, and shaped as a circle whose diameter is greater than that of the vibration plate 311. The planar shape of the concave part 321 is not limited to a circle, and may be a polygon.

In this embodiment, the concave part 321 has a through hole part 32*h* and a ring-shaped step part 32*c*, as shown in FIG. 5. The through hole part 32*h* penetrates through the sheet member 32 in the thickness direction. The ring-shaped step part 32*c* is formed on one side of the sheet member 32, as a recess around the through hole part 32*h*. The vibration plate 311 is supported on the ring-shaped step part 32*c*. This constitution is common to all concave parts 321 and piezoelectric vibration parts 31.

The mode in which the vibration plate 311 is supported on the ring-shaped step part 32*c* is not limited in any way, but typically the periphery part of the vibration plate 311 is joined all around to the ring-shaped step part 32*c*. The joining material is not limited in any way, but preferably a viscous material that can deform elastically is used because, this way, resonance fluctuation of the vibration plate 311 is suppressed and stable resonance operation of the vibration plate 311 can be ensured.

Also, the vibration plate 311 is not limited to the mode where it is joined all around to the ring-shaped step part 32*c*, and the vibration plate 311 may be constituted in such a way that it is supported in multiple regions along its periphery part. By constituting the vibration plate 311 this way so that its periphery part is partially retained, vibration of this periphery part is permitted, and unnecessary sound pressure peaks can be reduced in the high-frequency range. As a multi-point supporting structure along the periphery part of the vibration plate 311, for example, multiple projections that support the periphery part of the vibration plate 311 may be provided on the ring-shaped step part 32*c*, or multiple projecting pieces supported on the ring-shaped step part 32*c* may be provided radially from the periphery part of the vibration plate.

The sheet member 32 may be constituted by metal or other conductive material, or it may be constituted by plastic or other insulating material, or it may have a layered structure consisting of conductive layers and insulating layers. The aforementioned layered structure includes a wiring board.

As the sheet member 32 is constituted by a wiring board, it can be easily wired to each piezoelectric vibration part 31. In this case, signal wiring parts 32*s*1, 32*s*2 that are electrically connected to the wiring cable 105, are provided on the surface of the sheet member 32. The signal wiring parts 32*s*1, 32*s*2 are electrically connected to the respective piezoelectric vibration parts 31 via wiring members 313, as shown in FIG. 5.

FIG. 6 is an equivalent circuit diagram explaining the mode of wiring connection in the piezoelectric speaker 30. As shown in FIG. 6, the signal wiring part 32*s*1 is connected to the wiring cable 105, while the signal wiring part 32*s*2 is connected to ground. In other words, the respective piezoelectric vibration parts 31 are connected in parallel with respect to the signal source (wiring cable 105), and typically constituted so that they are driven synchronously.

As for the wiring members 313 connected between the vibration parts 31 and the signal wiring parts 32*s*1, 32*s*2, the respective wiring members 313 are connected to the aforementioned first and second lead electrode layers of the piezoelectric element 312 when the vibration part 311 is constituted by electrically insulating material. When the vibration plate 311 is constituted by metal or other conductive material, on the other hand, one lead electrode layer, selected from the first and second lead electrode layers, may be electrically contacted to the vibration plate 311. This way, the wiring members 313 can be connected to this one lead electrode layer via the vibration plate 311.

The piezoelectric element 312 may be joined to any face of the vibration plate 311. FIG. 5 shows a constitutional example where the piezoelectric element 312 is joined to the surface of the vibration plate 311 on the side not facing the space part 15 (FIG. 2). In contrast, the piezoelectric element 312 may be joined to the surface of the vibration plate 311 on the side facing the space part 15, as shown in FIG. 7A. Similarly, the through hole part 32*h* of the concave part 321 is not limited to the example where it is provided on the surface of the sheet member 32 on the side facing the space part 15; instead, it may be provided on the surface of the sheet member 32 on the side not facing the space part 15.

In the piezoelectric speaker 30 under this embodiment, the multiple piezoelectric vibration parts 31 are arranged in-plane on the sheet member 32 with a spacing (equal spacing or unequal spacing) provided in between, as shown in FIG. 3. This way, the multiple piezoelectric vibration parts 31 can be distributed over a wide area on the sheet member 32. The multiple piezoelectric vibration parts 31 may be respectively arranged at symmetrical positions with respect to the center of the sheet member 32. This way, acoustics having sound pressure characteristics that are symmetrical with respect to the center of the sheet member 32 can be generated. The multiple piezoelectric vibration parts 31 may be arranged along the circumference of the same circle on the sheet member 32, or they may be arranged in a grid.

In this embodiment, the multiple piezoelectric vibration parts 31 include a first piezoelectric vibration part 31A arranged at the center of the sheet member 32, and multiple second piezoelectric vibration parts 31B arranged at equal angle spacings around the first piezoelectric vibration part 31A. The number of second piezoelectric vibration parts 31B is not limited in any way, and in this embodiment, they are constituted by six piezoelectric vibration parts that are arranged at 60-degree spacings.

The first piezoelectric vibration part 31A may have a vibration plate whose diameter is greater than that of the second piezoelectric vibration part 31B. This way, acoustic characteristics having a peak level of sound pressure at the center part of the sheet member 32 can be achieved.

Also, the second piezoelectric vibration part 31B is not limited to the mode where they are arranged at equal angle spacings with respect to the center of the sheet member 32; instead, the arrangement spacings may be partially changed according to desired electroacoustic characteristics. Furthermore, the diameter and thickness of the vibration plate 311 of each piezoelectric vibration part 31 may be optimized individually. This way, a desired resonance distribution can be achieved in-plane on the sheet member 32, thereby enhancing the smoothness of sound pressure levels (SPL).

[Operation of Speaker Unit]

Next, in the speaker unit 104 constituted as described above, acoustic signals (reproduction signals) are input, via the wiring cable 105, to the dynamic speaker 20 and the piezoelectric speaker 30. In this embodiment, the dynamic speaker 20 primarily generates sound waves in the low range of 7 kHz or lower, while the piezoelectric speaker 30 primarily generates sound waves in the high range of 7 kHz or higher. The respective piezoelectric vibration parts 31 of the piezoelectric speaker 30 are typically driven simultaneously, with each piezoelectric vibration part 31 generating sound waves having the same acoustic characteristics.

In this embodiment, the piezoelectric speaker 30 has a structure where the multiple piezoelectric vibration parts 31 are supported commonly on the sheet member 32. This way, sound pressures in the high range can be improved without lowering the resonance frequency of each piezoelectric vibration part 31. As a result, dynamic speakers 20 (vibration plates 21) of larger diameters can be accommodated sufficiently.

According to this embodiment, where the multiple piezoelectric vibration parts 31 are respectively arranged in the multiple concave parts 321 of the sheet member 32, each piezoelectric vibration part 31 is prevented from projecting beyond the surface of the sheet member 32, and the piezoelectric speaker 30 can be made thinner as a result. Also, sufficient vibration space for each vibration plate 311 can be ensured, because the through hole part 32*h* is provided in the concave part 321.

Also, according to this embodiment, the constitution of each piezoelectric vibration plate 31 can be optimized independently, which makes it easy to adjust the resonance frequency and other acoustic characteristics.

Furthermore, the respective piezoelectric vibration parts 31 are arranged at symmetrical positions with respect to the center of the sheet member 32, and therefore acoustics having sound pressure characteristics that are symmetrical with respect to the center of the sheet member can be generated. Here, the acoustic characteristics of each piezoelectric vibration part 31 can be optimized to achieve a desired resonance distribution in-plane on the sheet member 32, as described above, and thereby enhance the smoothness of sound pressure levels, for example.

Furthermore, the passage part 311*h* provided in the vibration plate 311 of each piezoelectric vibration part 31 passes the acoustics in the low range as generated by the dynamic speaker 20. This way, the frequency characteristics of the sound waves reproduced by the dynamic speaker can be adjusted.

To be specific, desired frequency characteristics can be achieved with ease by flattening the composite frequency at the point of intersection (cross point) between the characteristics curve in the low range due to the dynamic speaker 20, and the characteristics curve in the high range due to the piezoelectric speaker 30.

The foregoing explained an embodiment of the present invention; however, it goes without saying that the present invention is not limited to the aforementioned embodiment, and various changes can be added.

For instance, the above embodiment explained a so-called hybrid electroacoustic transducer as an example; however, an electroacoustic transducer may be constituted by a piezoelectric speaker 30 alone. In this case, too, the apparent diameter of the vibration plate can be increased, which means that sound pressure levels can be improved while ensuring desired high-frequency characteristics.

Also, with respect to the piezoelectric speaker 30, the passage part 311*h* was provided in the vibration plate 311 of each piezoelectric vibration part 31 as an acoustic passage part in the above embodiment; however, the passage part 311*h* may be provided in-plane on the sheet member 32.

Also, in the above embodiment, each concave part 321 of the sheet member 32 was constituted by a bottomless through hole penetrating through the sheet member 32 in its thickness direction, as shown in FIG. 5; however, the constitution is not limited to the foregoing and a bottomed concave part 322 may be used, as shown in FIG. 7B, for example. In this case, the vibration plate 311 is supported on a bottom part 322*c* of the concave part 322.

The mode in which the vibration plate 311 is supported on the bottom part 322*c* is not limited in any way, but typically the periphery part of the vibration plate 311 is joined all around via a joining material 33. The joining material 33 is not limited in any way, but preferably a viscous material that can deform elastically is used so that resonance fluctuation of the vibration plate 311 is suppressed and stable resonance operation of the vibration plate 311 can be ensured. The thickness of the joining material 33 is not limited in any way, but preferably it is formed to a thickness that can ensure sufficient vibration space for the vibration plate 311.

It should be noted that each concave part of the sheet member 32 may be constituted by a simple through hole as shown in FIG. 8A, or the concave part itself may not be provided on the sheet member 32 as shown in FIG. 8B.

The concave part 323 shown in FIG. 8A is constituted by a through hole that penetrates through the sheet member 32 in its thickness direction, and the inner diameter of it is formed smaller than the outer diameter of the vibration plate 311. The vibration plate 311 is arranged on the surface of the sheet member 32 on one side in a manner covering the concave part 323, and its periphery part is supported on the sheet member 32, via the joining material 32, in a vibratable manner.

On the other hand, if the concave part is not provided on the sheet member 32, as shown in FIG. 8B, each piezoelectric vibration part 21 is arranged at an arbitrary position or prescribed, pre-determined position on the sheet member 32. In this case, too, the periphery part of each vibration plate 311 is supported on the surface of the sheet member 32 on one side, via the joining material 33, and sufficient vibration space is ensured for the vibration plate 311.

Or, if each concave part of the sheet member 32 is constituted by a simple through hole 323, then a convex part 324 or 325 may be provided around the through hole 323 in order to regulate the joining position of each vibration plate 311 to the sheet member 32, as shown in FIGS. 9A and 9B. The convex part 324 shown in FIG. 9A is constituted by a ring-shaped body having an inner diameter greater than the outer diameter of the vibration plate 311, and accommodating the vibration plate 311 inside and thereby regulates the joining position of the vibration plate 311 to the sheet member 32. On the other hand, the convex part 325 shown in FIG. 9B is constituted by a ring-shaped body having an outer diameter roughly identical to the outer diameter of the vibration plate 311, and is joined to the periphery part of the vibration plate 311 to regulate the joining position of the vibration plate 311 to the sheet member 32. The convex part 324 or 325 is not limited to the examples where it is constituted by a ring-shaped body; instead, it may be constituted by multiple projections provided intermittently around the vibration plate 311.

Even when the sheet member 32 has no concave part, a convex part 324 or 325 for regulating the joining position of each vibration plate 311 to the sheet member 32 may be provided, similarly, on the surface of the sheet member 32, as shown in FIGS. 10A and 10B. In the example shown in FIG. 10B, the vibration plate 311 is joined to the sheet member 32 via the convex part 325, which makes it easy to ensure sufficient vibration space for the vibration plate 311 and allows for optimization of the thickness of the joining material 33.

Additionally, while the above embodiment was constituted in such a way that the respective piezoelectric vibration parts 31 of the dynamic speaker 30 are simultaneously driven to reproduce acoustics in the high range, arbitrary piezoelectric vibration parts 31 may be driven in an arbitrary order, or arbitrary piezoelectric vibration parts 31 may be driven asynchronously with other arbitrary piezoelectric vibration parts 31. By arbitrarily selecting the piezoelectric vibration parts 31 to be driven this way, digital acoustic reproduction can be achieved.

DESCRIPTION OF THE SYMBOLS

10 Support
20 Dynamic speaker
21 Vibration plate (Second vibration plate)
30 Piezoelectric speaker
31 Piezoelectric vibration part
32 Sheet member
100 Headphones
104 Speaker unit
311 Vibration plate (First vibration plate)
312 Piezoelectric element

What is claimed is:

1. A piezoelectric speaker comprising:
a sheet member; and
multiple piezoelectric vibration parts, each having a vibration plate supported on the sheet member in a vibratable manner, and a piezoelectric element joined to the vibration plate,
wherein the vibration plate has a passage part provided between a periphery part of the vibration plate and the piezoelectric element and constituted by a single or multiple through holes.

2. A piezoelectric speaker according to claim 1, wherein the multiple piezoelectric vibration parts are arranged in-plane on the sheet member with a spacing provided in between.

3. A piezoelectric speaker according to claim 1, wherein the multiple piezoelectric vibration parts are arranged at symmetrical positions with respect to a center of the sheet member.

4. A piezoelectric speaker according to claim 1, wherein the multiple piezoelectric vibration parts include:
a first piezoelectric vibration part arranged at a center of the sheet member; and
multiple second piezoelectric vibration parts arranged around the first piezoelectric vibration part with an equal angle spacing provided in between.

5. A piezoelectric speaker according to claim 1, wherein the sheet member further has signal wiring parts that are electrically connected to the multiple piezoelectric vibration parts, respectively.

6. A piezoelectric speaker according to claim 1, wherein:
the sheet member has multiple bottomed or bottomless concave parts; and
the multiple piezoelectric vibration parts are arranged in the multiple concave parts.

7. A piezoelectric speaker according to claim 6, wherein:
the multiple concave parts have multiple through holes penetrating through the sheet member in a thickness direction, and multiple ring-shaped step parts that are respectively provided on one side of the sheet member as recesses around the multiple through holes; and
the vibration plates of the multiple piezoelectric vibration parts are respectively supported on the multiple ring-shaped step parts.

8. A piezoelectric speaker according to claim 1, wherein a planar shape of the piezoelectric element is a polygon.

9. A piezoelectric speaker according to claim 1, wherein:
the vibration plate has a planar shape approximating a circle;
a planar shape of the piezoelectric element is a polygon; and
the passage part is provided in a region between a side part of the piezoelectric element and the periphery part of the vibration plate.

10. An electroacoustic transducer comprising:
a sheet member;
multiple piezoelectric vibration parts, each having a first vibration plate supported on the sheet member in a vibratable manner, and a piezoelectric element joined to the first vibration plate;
a dynamic speaker facing the sheet member and having a second vibration plate; and
a support that supports the sheet member and the dynamic speaker.

11. An electroacoustic transducer according to claim 10, wherein:
the first vibration plate has a disk shape whose diameter is smaller than that of the second vibration plate; and
the sheet member has a disk shape whose diameter is the same as or greater than that of the second vibration plate.

12. An electroacoustic transducer according to claim 10, wherein the first vibration plate has a passage part provided between a periphery part of the first vibration plate and the piezoelectric element, and is constituted by a single or multiple through holes.

13. Headphones comprise:
a headband;

a pair of housings attached at both ends of the headband; and a pair of earpads respectively attached on an inner side of the housings;

wherein the pair of earpads are arranged in a manner covering both ears of a user when the user wears the headphones over his/her head, and the pair of housings have built-in speaker units, respectively, each speaker unit constituted by the electroacoustic transducer of claim 10.

14. The headphones according to claim 13, further comprising a wiring cable connected to the electroacoustic transducers to input drive signals to the speaker units.

* * * * *